US007849826B2

(12) United States Patent
Cho

(10) Patent No.: US 7,849,826 B2
(45) Date of Patent: Dec. 14, 2010

(54) VALVE SYSTEM

(75) Inventor: Yoonho Cho, Seoul (KR)

(73) Assignee: Hyundai Motor Company, Seoul (KR)

( * ) Notice: Subject to any disclaimer, the term of this patent is extended or adjusted under 35 U.S.C. 154(b) by 471 days.

(21) Appl. No.: 12/098,575

(22) Filed: Apr. 7, 2008

(65) Prior Publication Data

US 2009/0145379 A1 Jun. 11, 2009

(30) Foreign Application Priority Data

Dec. 5, 2007 (KR) ..... 10-2007-0125607

(51) Int. Cl.
*F01L 1/34* (2006.01)

(52) U.S. Cl. ..... 123/90.16; 123/90.44; 123/90.6; 123/90.48

(58) Field of Classification Search ..... 123/90.16, 123/90.31, 90.44, 90.6, 90.48; 29/888.1; 74/567, 569

See application file for complete search history.

(56) References Cited

U.S. PATENT DOCUMENTS 7,207,300 B2 * 4/2007 Ezaki et al. ..... 123/90.16

FOREIGN PATENT DOCUMENTS

JP 2001-123811 A 5/2001
KR 2000-0017311 A 3/2000

* cited by examiner

*Primary Examiner*—Ching Chang
(74) *Attorney, Agent, or Firm*—Morgan, Lewis & Bockius LLP

(57) ABSTRACT

A valve system includes a first valve provided on an intake or exhaust port; a second valve provided on another intake or exhaust port; a first cam unit on a camshaft, defining first and second lobe heights; and a second cam unit on the camshaft, defining a third lobe height. The first cam unit moves the first valve by a distance of either the first or the second lobe height, and the second cam unit moves the second valve by a distance of the third lobe height.

5 Claims, 2 Drawing Sheets

VALVE SYSTEM

CROSS-REFERENCE TO RELATED APPLICATION

This application claims priority to, and the benefit of, Korean Patent Application No. 10-2007-0125607, filed in the Korean Intellectual Property Office on Dec. 5, 2007, the entire contents of which are incorporated herein by reference.

BACKGROUND OF THE INVENTION (a) Field of the Invention

The present invention relates to a valve system including a cam and a variable tappet.

(b) Description of the Related Art

Recently, cylinder de-activation (CDA) is being widely used in vehicle engines. CDA improves fuel efficiency by stopping function of some of a vehicle's cylinders in idle or low load driving conditions.

A traditional variable tappet CDA valve system includes a variable tappet provided on an upper end of a valve stem. The variable tappet includes an inner tappet, an outer tappet, and a locking pin. First cams corresponding to the outer tappet, and a shorter, second cam corresponding to the inner tappet, are provided on a camshaft. The inner and outer tappets may move together or separately, depending on the position of the locking pin (which is operated by hydraulic pressure). The stem can be moved either by the first cams or by the shorter second cam.

However, the variable tappets are provided to all valves, so production cost is high. Particularly, two tappets are disposed in each of intake/exhaust ports per cylinder, and sixteen variable tappets are needed for a double over-head cam (DOHC) four cylinder engine.

The above information disclosed in this Background section is only for enhancement of understanding of the background of the invention and therefore it may contain information that does not form the prior art that is already known in this country to a person of ordinary skill in the art.

SUMMARY OF THE INVENTION

A valve system includes a first valve provided on an intake or exhaust port; a second valve provided on another intake or exhaust port; a first cam unit on a camshaft, defining first and second lobe heights; and a second cam unit on the camshaft, defining a third lobe height. The first cam unit moves the first valve by a distance of either the first or the second lobe height, and the second cam unit moves the second valve by a distance of the third lobe height.

The first cam unit may include a first cam defining the first lobe height, a second cam defining the second lobe height, and a variable tappet that controls movement of the first valve in a range from the first lobe height to the second lobe height. The variable tappet may include an inner and an outer tappet, the first cam corresponding to the outer tappet, and the second cam corresponding to the inner tappet.

The third lobe height may be approximately equal to the second lobe height.

DESCRIPTION OF REFERENCE NUMERALS INDICATING PRIMARY ELEMENTS IN THE DRAWINGS

Figure 1:
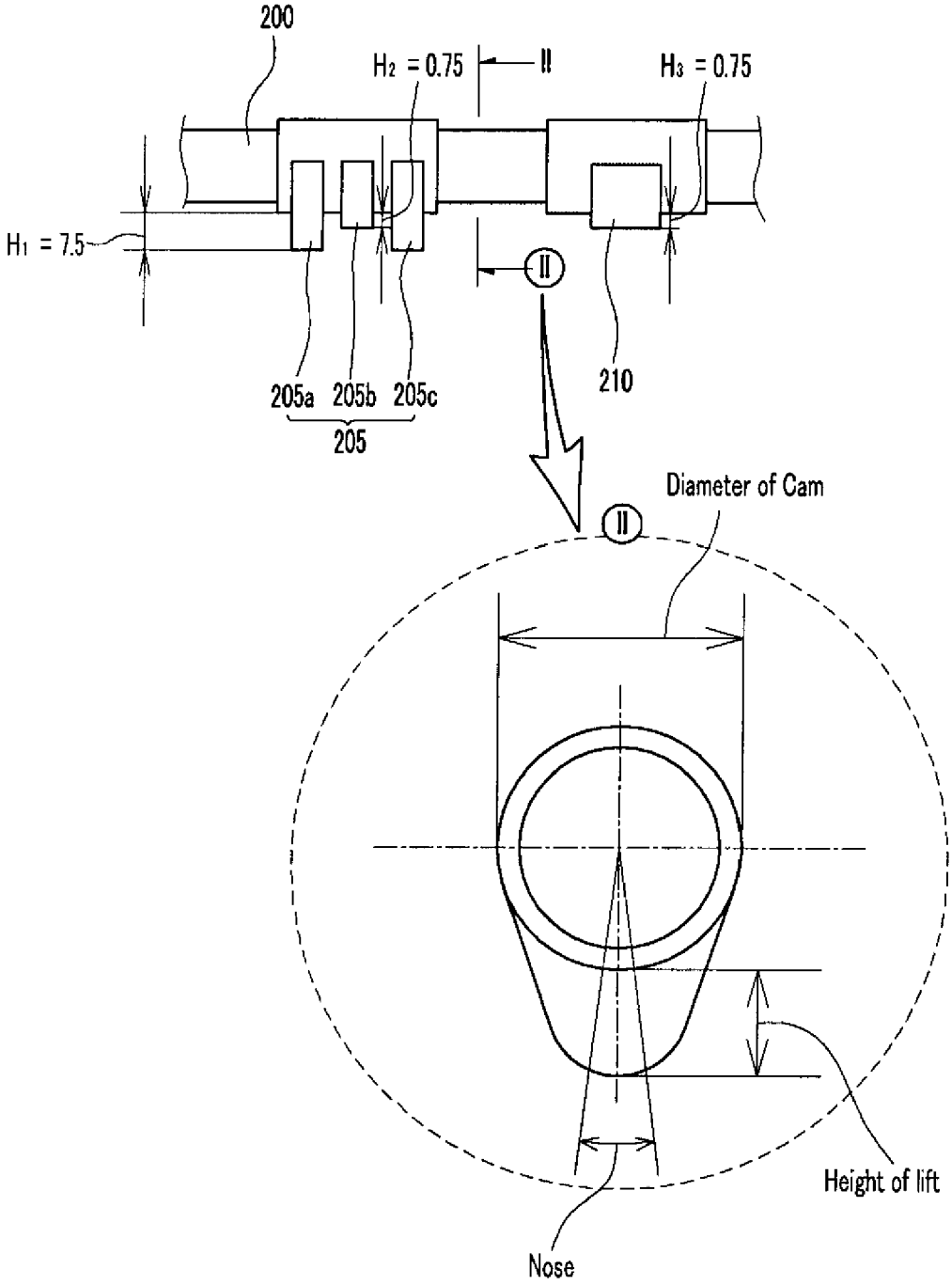
FIG. 1 is a partial side view showing a camshaft according to an exemplary embodiment of the present invention.

| |
|---|
| 200: camshaft |
| 205: first cam unit |
| 205a, 205c: first cams |
| 205b: second cam |
| 210: second cam unit |
| 300: variable tappet |
| 300a: inner tappet |
| 300b: outer tappet |
| 305a, 305b: stem |
| 310a, 310b: spring |
| 315a, 315b: supporting portion |
| 325: first valve |
| 330: second valve |
| 335, 340: port |

DETAILED DESCRIPTION OF PREFERRED EMBODIMENTS

The present invention will be described more fully hereinafter with reference to the accompanying drawings, in which exemplary embodiments of the invention are shown.

As those skilled in the art will realize, the described embodiments may be modified in various different ways, all without departing from the spirit or scope of the present invention. The drawings and description are to be regarded as illustrative in nature and not restrictive. Like reference numerals designate like elements throughout the drawings.

As shown in FIG. 1, a first cam unit 205 and a second cam unit 210 are provided on a camshaft 200. The first cam unit 205 includes first cams 205*a* and 205*c*, and a second cam 205*b* between the first cams 205*a* and 205*c*, The lobe height $H_1$ of the first cams 205*a* and 205*c* may be approximately 7.5 mm, and the lobe height $H_2$ of the second cam 205*b* may be approximately 0.75 mm.

In the illustrated embodiment, the first cam unit 205 and the second cam unit 210 can operate a valve in an exhaust port provided in one cylinder. Also, the first cam unit 205 and the second cam unit 210 can operate valves in two intake ports provided in another cylinder.

Figure 2:
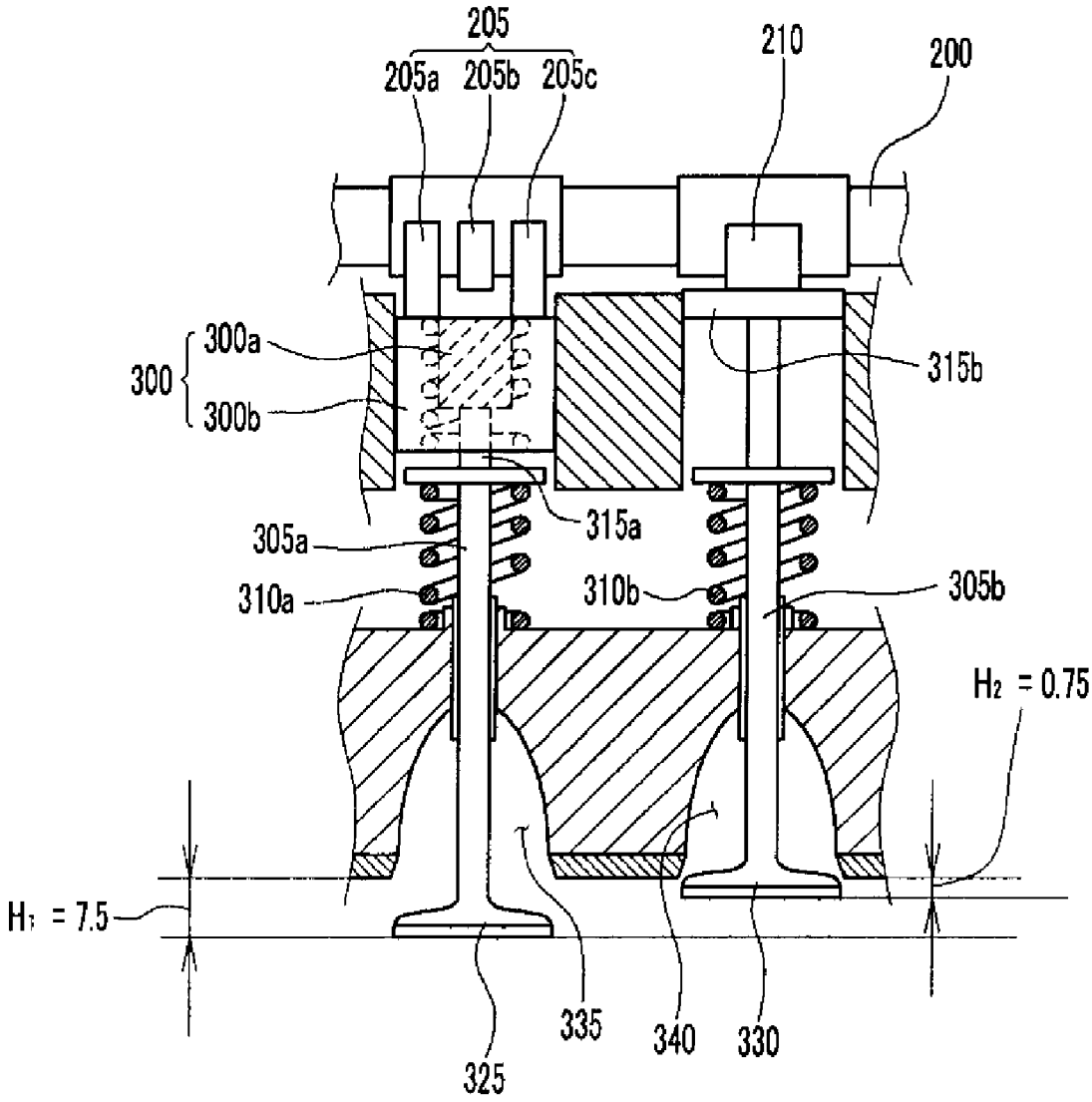
FIG. 2 is a cross-sectional view showing a valve system according to an exemplary embodiment of the present invention.

As shown in FIG. 2, in some embodiments, the valve system further includes a variable tappet 300, stems 305*a* and 305*b*, springs 310*a* and 310*b*, supporting portions 315*a* and 315*b*, a first valve 325, and a second valve 330. Two ports 335 and 340, each performing either intake or exhaust, are provided in a cylinder. The first valve 325 is provided in the port 335, and the second valve 330 is provided in the port 340.

The stems 305*a* and 305*b* are respectively connected to the first valve 325 and the second valve 330, and the supporting portions 315*a* and 315*b* are disposed at the ends of the stems 305*a* and 305*b*, respectively. The supporting portions 315*a* and 315*b* are elastically supported by the springs 310*a* and 310*b*, respectively. Accordingly, the valves 325, 330 close the ports 335, 340 by the springs 310*a*, 310*b*.

The variable tappet 300 is provided between the supporting portion 315*a* and the first cam unit 205 of the first valve 325. The second cam unit 210 contacts the supporting portion 315*b* at the end of the stem 305*b*. The first cam unit 205 pushes the variable tappet 300 according to the rotational position of the camshaft 200. The variable tappet 300 includes an outer tappet 300*b* and an inner tappet 300*a*. The first valve 325 can open as high as the lobe height $H_1$ or the lobe height $H_2$, according to the connection structure of the outer tappet 300*b* and the inner tappet 300*a*, in a manner that will be understood by a person of ordinary skill in the art based on the teachings herein.

The second cam 205*b* moves the first valve 325 as much as $H_2$ by the variable tappet 300, and the first cams 205*a*, 205*c* move the first valve 325 as much as $H_1$.

In some embodiments, the variable tappet 300 is not provided between the second cam unit 210 and the second valve 330. Accordingly, the second cam unit 210 always moves the second valve 330 the same amount $H_3$. In some embodiments, referring to FIG. 1, the lobe height $H_3$ of the second cam unit 210 may be substantially equal to the lobe height $H_2$ of the first cam unit 205 (given manufacturing tolerances, etc.).

Any number of second cam units 210 may be provided. In some embodiments, the lobe heights H3 of all the second cam units 210 are substantially equal (given manufacturing tolerances, etc.). Only one variable tappet 300 is necessary in only one of the ports 335, 340 of one cylinder in some embodiments. Also, in some embodiments, in a cylinder de-activation (CDA) situation (when a throttle valve [not shown] is closed), all the valves 325, 330 move as much as $H_2$ (which is equal to $H_3$). Accordingly, friction mean effective pressure (FMEP) is reduced, and fuel efficiency of the engine is improved.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A valve system comprising:

a first valve provided on a first intake or exhaust port;

a second valve provided on a second intake or exhaust port;

a first cam unit disposed on a camshaft, defining first and second lobe heights, the first cam unit being configured to move the first valve by a distance of either the first or the second lobe height; and a second cam unit disposed on the camshaft, defining a third lobe height, the second cam unit being configured to move the second valve by a distance of the third lobe height.

2. The valve system of claim 1, wherein the first cam unit comprises a first cam defining the first lobe height and a second cam defining the second lobe height.

3. The valve system of claim 2, wherein the first cam unit further comprises a variable tappet that controls movement of the first valve in a range from the first lobe height to the second lobe height.

4. The valve system of claim 3, wherein the variable tappet comprises an inner and an outer tappet, wherein the first cam corresponds to the outer tappet, and the second cam corresponds to the inner tappet.

5. The valve system of claim 1, wherein the third lobe height is equal to the second lobe height.

* * * * *